US005671576A

United States Patent [19]

Kluser

[11] Patent Number: 5,671,576

[45] Date of Patent: Sep. 30, 1997

[54] DEVICE FOR ATTACHING INSULATION MATERIALS

[75] Inventor: Remo Kluser, Altstätten, Switzerland

[73] Assignee: Hilti Aktiengeschaft, Fürstentuni, Liechtenstein

[21] Appl. No.: 599,690

[22] Filed: Feb. 12, 1996

[30] Foreign Application Priority Data

Feb. 10, 1995 [DE] Germany ..... 195 04 463.0

[51] Int. Cl.[6] ..... E04D 5/14

[52] U.S. Cl. ..... 52/512; 52/410; 52/708; 52/704; 411/383; 411/533

[58] Field of Search ..... 52/512, 410, 704, 52/708; 411/383, 387, 533, 384, 368, 369

[56] References Cited

U.S. PATENT DOCUMENTS

| | | | |
|---|---|---|---|
| 1,855,329 | 4/1932 | Wagner . | |
| 5,066,181 | 11/1991 | Bogel | 52/512 X |
| 5,171,118 | 12/1992 | Rothenbuhler | 52/512 X |
| 5,177,922 | 1/1993 | Ovaert | 52/512 X |
| 5,426,905 | 6/1995 | Rollhauser | 52/512 |

FOREIGN PATENT DOCUMENTS

| | | |
|---|---|---|
| 3318800 | 11/1984 | Germany . |
| 9210449 | 12/1992 | Germany . |
| 4407349 | 9/1995 | Germany . |

*Primary Examiner*—Christopher T. Kent
*Attorney, Agent, or Firm*—Anderson, Kill & Olick, P.C.

[57] ABSTRACT

A device for attaching insulation material (13) of different thicknesses to a base material, such as a structural member, is formed of a receptacle (1) to be fastened to the base material and a pressure component (4) to be secured in a positively locked manner to the receptacle. The pressure component (4) includes a shaft (3) and a head (2) extending laterally outwardly from the shaft. An axially extending slot (9) in the shaft (3) serves for easier compression of the device and permits inward radial deformation of the shaft (3). The pressure component (4) is finally fixed to the receptacle (1) by a stud-shaped expanding element (8) driven in a central throughbore (7) in the shaft for preventing radial deformation of the shaft (3).

5 Claims, 1 Drawing Sheet

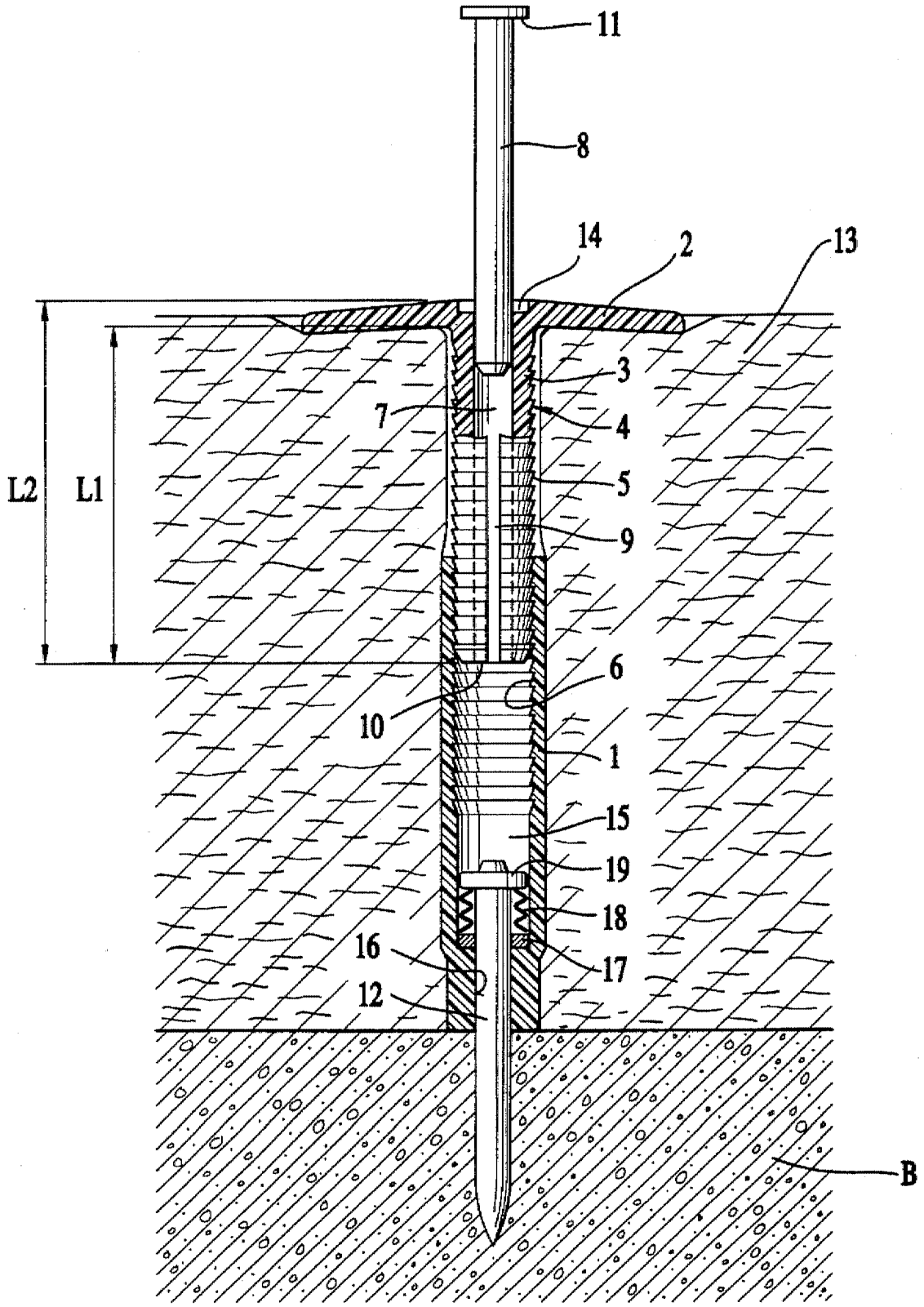
11
8
14
2
13
3
7
4
L2
L1
5
9
6
10
1
15
19
18
16
17
12
B

DEVICE FOR ATTACHING INSULATION MATERIALS

BACKGROUND OF THE INVENTION

The invention is directed to a device for attaching insulation material to a base material, such as a structural member, and includes a receptacle to be fastened to the base material and a pressure component with a large area head and a shaft projecting axially from the head and containing a central throughbore. The shaft is insertable into the receptacle and the shaft and receptacle have profiled or shaped surfaces for effecting a positively locked connection between them.

A device for securing plates or panels of insulation material of different thicknesses on flat roofs is disclosed in DE-OS 34 18 028. This device is formed of a pressure component and a receptacle, where the receptacle is fastened to a part of the roof by a threaded connection and is in positively locked connection with the pressure component. The pressure component includes a large area head bearing against the surface of the insulation material and a shaft with a throughbore which extends into a receiving bore in the receptacle and is formed as a single piece with the head. The positively locked connection is achieved by profiled surfaces on the shaft and the receptacle, whereby the profiled surface on the shaft extends over its full outside surface and the profiled surface on the receptacle extends at least for the full inside surface of the receiving bore. If the parts of the device are pressed together or compressed, for a short time there is an elastic deformation of the profiled surfaces on the shaft and the receptacle. The force expended in such deformation increases with increased penetration due to the ever larger regions of the profiled surfaces cooperating with one another. Placement of a large number of such devices requires a large expenditure of force and is very laborious for the operator.

SUMMARY OF THE INVENTION

Therefore, the primary object of the present invention is to provide a device for attaching insulation material which can be attached simply and economically to a base material, so that insulating material of varying thicknesses can be attached in a simple manner and with little expenditure of force.

In accordance with the present invention, a stud-shaped expanding element can be driven into the throughbore of the pressure component by providing at least one axially extending slot in the shaft of the pressure component with the slot extending from a leading end of the shaft for at least a portion of its length.

Due to the arrangement of the axially extending slot, radial deformability of the shaft is afforded so that a compression of the device is possible. When the large area head of the pressure component rests against the insulating material, the stud-shaped expanding element is driven into the throughbore of the shaft and widens the shaft in the region of the axially extending slot to its original cross section and prevents any further radial deformation of the shaft.

Devices for attaching insulation material of small thickness must be compressed as far as possible so that the head of the pressure component is located in the vicinity of a trailing end of the receptacle. Accordingly, the profiled surface of the shaft extends at least over its entire axial length. For ease in compressing the device, the axially extending slot extends along the full length of the shaft.

The length of the expanding element corresponds advantageously to the length of the pressure component, so that radial deformation in the region of the profiled surface is prevented and to afford a closure of the central throughbore in the region of the large area head.

The correct driving depth for insertion of the expanding element is obtained, when the trailing end of the expanding element spaced from the receptacle extends parallel to the surface of the large area head directed outwardly away from the insulation material. Preferably, the expanding element has a stop-face extending transversely outwardly from its outside surface, whereby the expanding element cannot be driven for an excessive depth into the shaft.

To prevent radial deformation or radial compression of the shaft, the central throughbore has to be filled. This feature is expediently achieved by the expanding element whose cross section corresponds to the cross section of the central throughbore.

IN THE DRAWING

The drawing is an axially extending view, partly in section, of a device embodying the present invention for securing insulation material to a base material.

DETAILED DESCRIPTION OF THE INVENTION

As shown in the drawing, the device is formed of a hollow axially extending receptacle 1, a pressure component 4, and an axially extending stud-shaped expanding element 8 for attaching insulation material 13 to the surface of a base material B. The axially extending hollow receptacle 1 is fixed at its leading end to the surface of the base material B by a nail or stud 12 driven into the base material. Stud 12 is guided in a centrally arranged throughbore 16 in the leading end region of the receptacle and has a head 19 at the trailing end of the stud for contact with an axially deformable element 18. A washer 17 is located at a transition surface between the throughbore 16 and a radially widened receiving bore 15 extending towards the trailing end of the receptacle. The stud 12 has a diameter corresponding essentially to the diameter of the throughbore 16. Head 19 on the stud 12 has a diameter corresponding essentially to the diameter of the receiving bore 15 and serves for guidance of the stud 12 within the receptacle 1.

As shown in the drawing, the receptacle 1 is in positively locked engagement with the pressure component 4. Pressure component 4 has an axial length L2 composed of an axially extending shaft 3 having an axial length L1 with a large area head 2 at the trailing end of the shaft with the head bearing against the insulation material 13. The shaft 3 and the large area head 2 form a single piece. Shaft 3 has a sawtooth-like profiled surface 5 extending along the outside surface of the shaft 3. A matching profiled surface 6 is formed on the inside surface of the receiving bore 15 of the receptacle 1 and extends for at least a part of the total length of the receiving bore 15.

To afford elastic yielding of the profiled surface 5 on the shaft 3 or a radial deformation of the shaft 3 on compression of the device, an axially extending slot 9 is formed in the shaft extending from its leading end 10 for the axial length L1 of the shaft.

To prevent radial deformation of the shaft 3 when the device is compressed and the large area head 2 rests against the insulation material, a stud-shaped expanding element 8 is driven into a axially extending central throughbore 7 of the shaft 3 with the transverse cross-section of the expanding element matched to the cross section of the central throughbore 7. The axial length of the stud-shaped expanding element 8 corresponds to the axial length L2 of the pressure component 4. At its trailing end, the expanding element 8 has a stop face 11 extending radially outwardly from the outside surface of the component and in the fully inserted position it rests in a receiving region 14 in the outer surface of the large area head 2. As a result, correct positioning of the expanding element 8 in the central throughbore is obtained.

While specific embodiments of the invention have been shown and described in detail to illustrate the inventive principles, it will be understood that the invention may be embodied otherwise without departing from such principles.

What is claimed is:

1. A device for attaching insulation material (13) to a base material (B), such as a structural member, comprising an axially extending hollow receptacle (1) having a leading end to be fastened to a surface of the base material and a trailing end to be spaced outwardly from the base material, and a pressure component (4) having an axially extending shaft (3) with an axial length (L1) and a central throughbore (7), said shaft (3) having a leading end to be inserted into the trailing end of said receptacle and a trailing end with a large area head (2) projecting laterally outwardly from said shaft (3), said receptacle (1) having an inside surface and said shaft (3) having an outside surface each having a profiled surface (5, 6) arranged to interconnect in a positively locked manner, said shaft (3) having at least one axially extending slot therethrough extending from the leading end thereof for at least a part of the axial length (L1) thereof, and an axially elongated stud-shaped expanding element (8) drivable into said throughbore (7) of the said shaft (3) from the trailing end towards the leading end.

2. The device, as set forth in claim 1, wherein said slot (9) extends for the axial length (L1) of said shaft (3).

3. The device, as set forth in claim 1 or 2, wherein the axial length of said expanding element (8) corresponds to an axial length (L2) of said pressure component (4).

4. The device, as set forth in claim 3, wherein said expanding element (8) has a leading end to be inserted first into the throughbore of said shaft (3) and a trailing end with a stop face at said trailing end extending radially outwardly from an outside surface of said expanding element (8).

5. The device, as set forth in claim 4, wherein said stud-shaped expanding element (8) has a transverse cross section corresponding to a transverse cross section of said central throughbore (7).

* * * * *

UNITED STATES PATENT AND TRADEMARK OFFICE

CERTIFICATEOF CORRECTION

PATENT NO. : 5,671,576

DATED : September 30, 1997

INVENTOR(S) : Remo Kluser

It is certified that error appears in the above-identified patent and that said Letters Patent is hereby corrected as shown below:

Item

{73} Assignee: Hilti Aktiengesellschaft, Fürstentum, Liechtenstein

Signed and Sealed this

Eleventh Day of August 1998

Bruce Lehman

*Attest:*

BRUCE LEHMAN

*Attesting Officer*

*Commissioner of Patents and Trademarks*